US006257253B1

(12) United States Patent
Lentsch et al.

(10) Patent No.: US 6,257,253 B1
(45) Date of Patent: Jul. 10, 2001

(54) PERCARBOXYLIC ACID RINSE METHOD

(75) Inventors: Steven Eugene Lentsch, St. Paul; Dale W. Groth, Edina; Thomas R. Oakes, Lake Elmo; Burton M. Baum, Mendota Heights, all of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 08/229,648

(22) Filed: Apr. 19, 1994

(51) Int. Cl.[7] ..... B08B 9/20
(52) U.S. Cl. ..... 134/25.2; 134/3; 134/15; 134/23; 134/34
(58) Field of Search ..... 134/3, 17, 22.12, 134/22.14, 22.15, 22.18, 23, 25.2, 34, 58, 6, 9, 15

(56) References Cited

U.S. PATENT DOCUMENTS

| | | | | |
|---|---|---|---|---|
| Re. 30,537 | | 3/1981 | Fraula et al. . | |
| 349,852 | | 9/1886 | Marchand . | |
| 1,772,975 | | 8/1930 | Wieland . | |
| 2,466,663 | | 4/1949 | Russ et al. . | |
| 2,592,884 | | 4/1952 | Fox et al. . | |
| 2,592,885 | | 4/1952 | Fox et al. . | |
| 2,592,886 | * | 4/1952 | Fox et al. | 299/85 |
| 2,833,813 | | 5/1958 | Wallace . | |
| 3,044,092 | | 7/1962 | Fox et al. . | |
| 3,146,718 | | 9/1964 | Fox et al. . | |
| 3,297,456 | | 1/1967 | Newell . | |
| 3,370,597 | * | 2/1968 | Fox et al. | 134/58 |
| 3,592,774 | | 7/1971 | Altensch pfer . | |
| 3,625,901 | | 12/1971 | Rue et al. . | |
| 3,650,965 | | 3/1972 | Cantor et al. . | |
| 3,867,300 | | 2/1975 | Karabinos et al. . | |
| 3,915,633 | | 10/1975 | Ramachandran . | |
| 3,941,713 | | 3/1976 | Dawson et al. . | |
| 4,002,775 | | 1/1977 | Kabara . | |
| 4,005,024 | | 1/1977 | Rodriguez et al. . | |
| 4,011,346 | | 3/1977 | Ernst . | |
| 4,051,058 | * | 9/1977 | Bowing et al. | 252/186 |
| 4,051,059 | | 9/1977 | Bowing et al. . | |
| 4,147,559 | | 4/1979 | Fraula et al. . | |
| 4,187,121 | | 2/1980 | Herold et al. . | |
| 4,203,765 | | 5/1980 | Claeys et al. . | |
| 4,376,787 | | 3/1983 | Lentsch et al. . | |
| 4,404,040 | | 9/1983 | Wang . | |
| 4,406,884 | | 9/1983 | Fawzi et al. . | |
| 4,410,442 | | 10/1983 | Lucas et al. . | |
| 4,430,381 | | 2/1984 | Harvey et al. . | |
| 4,534,945 | | 8/1985 | Hopkins et al. . | |
| 4,557,935 | | 12/1985 | af Ekenstam et al. . | |
| 4,624,713 | | 11/1986 | Morganson et al. . | |
| 4,647,458 | | 3/1987 | Ueno et al. . | |
| 4,715,980 | | 12/1987 | Lopes et al. . | |
| 4,776,974 | | 10/1988 | Stanton et al. . | |
| 4,824,591 | * | 4/1989 | Dyroff et al. | 252/94 |
| 4,900,721 | | 2/1990 | Bansemir et al. . | |
| 4,920,100 | | 4/1990 | Lehmann et al. . | |
| 4,945,110 | | 7/1990 | Brokken et al. . | |
| 5,013,560 | | 5/1991 | Stentz et al... . | |
| 5,017,617 | | 5/1991 | Kihara et al. . | |
| 5,122,538 | * | 6/1992 | Lokkesmoe et al. | 514/557 |
| 5,200,189 | * | 4/1993 | Oakes et al. | 424/405 |

FOREIGN PATENT DOCUMENTS

| | | |
|---|---|---|
| 1 174 976 | 9/1984 | (CA) . |
| 0 021 504 | 1/1981 | (EP) . |
| 0 068 552 | 1/1983 | (EP) . |
| 0 083 820 | 7/1983 | (EP) . |
| 0 147 102 | 12/1983 | (EP) . |
| 0 097 995 | 1/1984 | (EP) . |
| 0 193 416 | 9/1986 | (EP) . |
| 0 218 441 | 4/1987 | (EP) . |
| 0 244 144 | 11/1987 | (EP) . |
| 0 245 928 | 11/1987 | (EP) . |
| 0 288 689 | 11/1988 | (EP) . |
| 0 375 827 | 7/1990 | (EP) . |
| 1 135 643 | 12/1968 | (GB) . |
| 2 076 286 | 12/1981 | (GB) . |
| 2 103 089A | 2/1983 | (GB) . |
| 2 187 097A | 9/1987 | (GB) . |
| 2 189 394A | 10/1987 | (GB) . |
| 2 211 093A | 6/1989 | (GB) . |
| 59-157007 | 9/1984 | (JP) . |
| 62-048612 | 3/1987 | (JP) . |
| WO 83/00163 | 1/1983 | (WO) . |
| WO 87/03799 | 7/1987 | (WO) . |
| WO 87/06470 | 11/1987 | (WO) . |
| WO 91/05842 | 5/1991 | (WO) . |
| 91/15122 | 10/1991 | (WO) . |

OTHER PUBLICATIONS

Food Acidulants, pp. 7, 13, 44 and Chapter 8, pp. 97–114.

Kirk–Othmer Encyclopedia of Chemical Technology, Third Edition: Dicarboxylic Acids, vol. 7, pp. 614–628.

Kirk–Othmer Encyclopedia of Chemical Technology, Third Edition: Carbonated Beverages, vol. 4, pp. 712–713.

Kirk–Othmer Encyclopedoa of Chemical Technology, Third Edition: Citric Acid, vol. 6, pp. 150–178.

Kirk–Othmer Encyclopedia of Chemical Technology, Third Edition: Hydroxy Carboxylic Acids, vol. 13, pp. 80–120.

Kirk–Othmer Encyclopedia of Chemical Technology, Third Edition: Carboxylic Acids, vol. 4, pp. 814–834 and pp. 855–871.

(List continued on next page.)

*Primary Examiner*—Arlen Soderquist
(74) *Attorney, Agent, or Firm*—Merchant & Gould P.C.

(57) ABSTRACT

The invention includes compositions and methods for sanitizing ware without staining or spotting. In its most preferred mode, the method comprises the steps of washing the ware in an automated ware washing machine and rinsing the ware at either high or low temperatures with a sanitizing rinse composition. The destaining, sanitizing concentrate composition preferably comprises peroxy acetic acid, acetic acid, and hydrogen peroxide. The sanitizing rinse composition may preferably be used at a concentration ranging from about 600 ppm to 4000 ppm.

14 Claims, No Drawings

OTHER PUBLICATIONS

Disinfection, Sterilization, and Preservation, Fourth Edition, Seymour S. Block, 1991, Chapter 47, "Chemical Food Preservatives".
Disinfection, Sterilization, and Preservation, Second Edition, Seymour S. Block, 1977, Chapter 16, "Acid–Anionic Surfactant Sanitizers".
Code of Federal Regulations, 21 C.F.R. Ch. 1 (4–1–91 Edition), pp. 311–318.
Kirk–Othmer, Encyclopedia of Chemical Technology, Third Edition, vol. 12, pp. 46, 61 and 62.
The Food Chemical News Guide, Oct. 7, 1991.
The Food Chemical News Guide, Jun. 26, 1989.
Clinical Toxicology of Commercial Products, Fifth Edition, Gosselin et al, Section III, Ethylene Glycol, 1984, p. 172.
Indusrial Gums Polysaccharides and Their Derivatives, Whistler, Second Edition, Chapter XIX, Pectin, Towle et al, pp. 429–455.
Food Science and Technology, "A Series of Monographs, " Stewart et al, pp. 186–187.
Chemical Abstracts, Abstracts No. 95723, vol. 111, page 610, Sep. 11, 1989.
Food Chemical Codex, Second Edition, Committee on Specification . . . , pp. 12–14, 1972.
Schick, "Nonionic Surfactants", published by Marcel dekker and John L. Wilson, *Soap and Chemical Specialties*, Feb. 1958. Rinse Additives, pp. 48–52 and 170–171.
Solvent Properties of Surfactant Solutions, vol. 2, Frederic R. Benson, 1967 Nonionic Surfactants, pp. 260–297.
Research Note: Salmonella Decontamination of Broiler Carcasses with Lactic Acid, L–Cysteine, and Hydrogen Peroxide by R.W.A.W. Mulder et al., pp. 1555–1557, Nov. 7, 1986.
17–Food, Feed Chem. vol. 108, 1988, 108:166345q Disinfectant compositions containing aqueous lower alcohol, acidic component, and amino–or ammonium–based microbicide, page 549.
17–Food, Feed Chem. vol. 111, 1989, 111:95723k Study of calcium binding to phosphoserine residues of –casein and its phosphopeptide (1–25) by $^{31}$P NMR.
PCT International Search Report.
Derwent Publication Ltd., London, Great Britian, AN 86–229179 & JP–A–61 159 498 (KAO CORP.), Jul. 19, 1986.

* cited by examiner

PERCARBOXYLIC ACID RINSE METHOD

FIELD OF THE INVENTION

The invention is a method and composition for sanitizing and rinsing ware articles used for the preparation, serving and consumption of food. The invention provides spot-free, film-free ware products upon rinsing with an added sanitizing effect. The invention may be used in either manual or automated washing and rinsing processes to provide a high level of sanitizing efficacy without the harmful drawbacks of certain other sanitizing agents such as halogens. Generally, the sanitizing agent of the invention comprises one or more carboxylic acids and peroxide to result in a composition which preferably comprises, at equilibrium, hydrogen peroxide, carboxylic acid, and peroxycarboxylic acid.

BACKGROUND OF THE INVENTION

In high volume institutional food preparation and service installations, chemical sanitizing compositions are often used in manual and automated ware washing processes to destroy bacteria during rinsing operations to meet minimum sanitation standards. In many installations sanitation standards are met through the use of very high temperature rinse water (180°–195° F.). Where such temperatures are not achievable, a chemical sanitizing agent is often added to one or more aqueous material that contacts kitchenware or tableware to produce a bacteria killing effect at the low temperature conditions of approximately 120–140° F. The use of the terms "high temperature" and "low temperature" herein relate approximately to the above temperature ranges.

Low temperature methods and equipment are illustrated in the following, Fox et al., U.S. Pat. Nos. 2,592,884, 2,592,885, and 2,592,886, 3,044,092 and 3,146,718, as well as Fox, U.S. Pat. No. 3,370,597. In large part, these machines follow a cleaning regimen wherein the soiled kitchenware or tableware can be prescraped either manually or with an automatic machine scraping stage involving a water spray to remove large bulk soil. The ware can then be directed to a zone wherein the ware is contacted with an aqueous alkaline cleaning composition that acts to remove soil by attacking protein, fat or carbohydrate soils chemically. The cleaned ware can then be directed to a sanitizing stage wherein the ware is contacted with sanitizer material. Alternatively, the ware may be directed to a combined rinsing-sanitizing stage where the ware is contacted with a combination of rinse agent and sanitizer. Lastly, the ware can be directed to a stage where the articles are dried either actively by heating or passively by ambient evaporation.

The need for sanitization has lead to the consideration of various agents. One of the most common sanitizers for ware washing is aqueous sodium hypochlorite (NaOCl). However, while sodium hypochlorite is effective, low cost and generally available, sodium hypochlorite has several disadvantages. First, hypochlorite can react with hardness ions in service water including calcium, magnesium, iron, manganese, etc. Such chemical interaction can cause liming and mineral deposits on machine parts. Such deposits can tend to form in and on the water passages of a ware washing machine which can substantially change the flow rates of various aqueous materials through the machine. Any such change can seriously reduce the effectiveness of machine operation. Chlorine, as a constituent of sodium hypochlorite, may also present compatibility problems when used with other chemicals which have desirable sheeting and rinse aid characteristics, such as nonionic surfactants. Further, the interaction between sodium hypochlorite and various minerals in service water can result in the spotting and filming of ware products.

Sodium hypochlorite use tends to substantially increase the total dissolved solids present in aqueous sanitizing compositions. High concentrations of solids can tend to increase the tendency of agents to leave unwanted spotting and streaking upon drying. In fact, while chlorine has a noted sanitizing effect, the increased solids resulting from this constituent can film, spot and otherwise leave a residue on ware products subjected to the rinse. Chlorine may also react and degrade or corrode tableware comprising metals as well as metals found in the environment of use.

Sodium hypochlorite is also a strong oxidizing chemical and can substantially corrode a variety of materials used in machine manufacture and in tableware and kitchenware commonly used in today's institutional environment. Lastly, spills of sodium hypochlorite are unpleasant, can cause damage to bleachable surfaces, and are difficult to clean.

In the meantime, various rinse aid compositions have been developed for use in both low temperature and high temperature wash systems. For example, Fraula et al., U.S. Pat. No. 4,147,559 and U.S. Reissue Pat. No. 30,537 teach an apparatus and a method for rinsing and chemically sanitizing foodware items. The disclosure is primarily directed to machine related components for ensuring adequate cleaning and sanitizing.

Further, a number of rinse aid compositions, based largely on nonionic surfactants without sanitizers are also known. Altenschopfer, U.S. Pat. No. 3,592,774, teaches saccharide-based nonionic rinsing agents. Rue et al., U.S. Pat. No. 3,625,901, teach surfactants used as rinse aids having low foaming properties. Dawson et al., U.S. Pat. No. 3,941,713, teach machine ware washing rinse agents having an anti-resoiling or non-stick additive for treating aluminum or other such metal kitchenware. Rodriguez et al., U.S. Pat. No. 4,005,024, teach a rinse aid composition containing organosilane and monofunctional organic acids that act as rinse agents. Herold et al., U.S. Pat. No. 4,187,121, teach a rinse agent concentrate based on saccharide glycol ether technology.

Further, Morganson et al., U.S. Pat. No. 4,624,713, teach a solidified rinse agent composition containing a nonionic rinsing agent, urea, water and other components. Surveys of nonionic surfactants and rinse additives containing nonionic surfactants are found in Schick, "Nonionic Surfactants", published by Marcel Dekker, and John L. Wilson, *Soap and Chemical Specialties*, February 1958, pp. 48–52 and 170–171.

However, none of these rinse aids have been able to combine effective sheeting and rinsing action with sanitizing efficacy. Accordingly, a strong need exists in the art to provide a rinsing sanitizing agent that can promote sheeting and removal of spotting, provide substantial sanitizing action, work safely within the environment, and result in operations without any substantial deposit formation on ware or dish machines or corrosion of machine components or kitchenware, tableware, etc.

BRIEF DESCRIPTION OF THE INVENTION

In accordance with a first aspect of the invention there is provided, a method of sanitizing and destaining ware comprising the step of applying a sanitizing, destaining concentrate composition comprising a peroxycarboxylic acid, a $C_{1-6}$ carboxylic acid, hydrogen peroxide, and a balance of carrier.

In accordance with a more preferred aspect of the invention, there is provided a method of sanitizing ware without creating a film residue comprising the steps of washing the ware in an automated ware washing machine, and rinsing the ware at a temperature ranging from about 120° F. to 140° F. with a sanitizing destaining concentrate composition comprising peroxy acetic acid, acetic acid, and hydrogen peroxide in an aqueous carrier. Optionally, the rinsing step may also comprise the introduction of a sheeting agent into the automated ware washing machine during the rinsing step or a combined product may be used where the sheeting agent is combined with the sanitizer.

The invention is a method for destaining and sanitizing tableware. The invention generally comprises a peroxyacid material which optionally may be used in combination with effective sheeting agents that provide improved destaining and sanitization, but does not cause significant corrosion of machine parts or ware. We have found that the effective concentration of the materials result in low total solids formulations which substantially resist spotting. More specifically, as the sanitizing destaining concentrate composition of the invention comprises a peroxyacid, the composition generally evaporates from, rather than filming on, the ware subjected to the rinse.

Lastly, the carboxylic acids to which the peroxy acids degrade are non-toxic and non-corrosive and are compatible with commonly available materials used in the manufacture of dish machines, kitchenware, tableware and glassware.

For the purpose of this invention, the term "sheeting or rinse agent" refers to the chemical species that causes the aqueous rinse to sheet. The term "rinse aid" reflects the concentrated material which is diluted with an aqueous diluent to form aqueous rinse. The terms "ware, tableware, kitchenware or dishware" refers to various types of articles used in the preparation, serving and consumption of foodstuffs including pots, pans, baking dishes, processing equipment, trays, pitchers, bowls, plates, saucers, cups, glass, forks, knives, spoons, spatulas, grills, griddles, burners and the like including those materials made from polymeric thermoplastics and thermosetts, ceramics including fired and blown glasses, and elemental and alloyed metals such as silver, gold, bronze, copper, pewter, and steel among other materials. The term "rinsing" or "sheeting" relates to the capacity of the aqueous rinse when in contact with tableware to form a substantially continuous thin sheet of aqueous rinse which drains evenly from the ware leaving little or no spotting upon evaporation of the water.

The invention is concerned primarily with low temperature equipment in cleaning and sanitizing articles, but can be applicable to high temperature machines to provide an increased degree of confidence that ware are adequately destained and sanitized.

DETAILED DESCRIPTION OF THE INVENTION

The invention is a method of sanitizing and destaining ware, including those utensils used in the preparation, serving, and consumption of food and foodstuffs. The method of the invention includes the application of a sanitizing concentrate comprising a peroxycarboxylic acid reaction product of one or more carboxylic acids and an oxidizer. Optionally the composition of the invention may also comprise oxidizer stable sequestrants and solubilizers as well as other adjuvants such as carriers, sheeting agents, etc. which are also stable in the presence of an oxidizer. These adjuvants may be premixed with the composition of the invention, as well as separately introduced into the environment of use simultaneously or after the rinse aid of the invention.

The concentrate of the invention is typically formulated in a liquid diluent compatible with the peroxyacid sanitizer and any rinse aids present in the composition. The uniqueness of the invention relates to the fact that the active components (1) are stable at substantial concentrations in the undiluted concentrate, (2) are significant improvements over the use of sodium hypochlorite in an aqueous rinse, and (3) provide effective sheeting as well as improved ware appearance. Lastly, the compositions of the invention are non-corrosive in contact with materials common in the automatic dish machines and in ware.

A. The Sanitizing, Destaining Concentrate

The compositions of the invention contain a peroxycarboxylic acid sanitizing composition. The peroxycarboxylic acid sanitizer material can comprise at least one monocarboxylic acid having from 1 to about 6 carbon atoms. Commonly, the peroxycarboxylic acid material can be made by oxidizing a monocarboxylic acid directly to the per acid material which is then solubilized in the aqueous concentrate compositions of the invention. Further, the materials can be made by combining the unoxidized acid with hydrogen peroxide to generate the acid in situ either prior to blending the fatty peroxyacid with the concentrate or after the concentrate is formulated.

Generally when the peroxycarboxylic acid is formulated in accordance with the invention, a monocarboxylic acid, such as acetic acid, is combined with an oxidizer such as hydrogen peroxide. The result of this combination is a reaction producing a peroxycarboxylic acid, such as peroxy acetic acid, and water. The reaction follows an equilibrium in accordance with the following equation:

$$H_2O_2+CH_3COOH \rightleftharpoons CH_3COOOH+H_2O$$

wherein the $K_{eq}$ is 2.0.

The importance of the equilibrium stems from the presence of hydrogen peroxide, the carboxylic acid and the peroxycarboxylic acid in the same composition at the same time. This combination provides enhanced sanitizing with none of the deleterious corrosive or tarnishing effects of other rinse agents, additives, or compositions.

The first constituent of the equilibrium mixture comprises one or more carboxylic acids. Generally, carboxylic acids have the formula R—COOH wherein the R may represent any number of different groups including aliphatic groups, alicyclic groups, aromatic groups, heterocyclic groups, all of which may be saturated or unsaturated as well as substituted or unsubstituted. Carboxylic acids also occur having one, two, three, or more carboxyl groups.

Carboxylic acids provide a precursor reactant to the peroxycarboxylic acid and acidify aqueous compositions in which they are present as the hydrogen atom of the carboxyl group is active. Moreover, the carboxylic acid constituent within the invention maintains the composition at an acidic pH which stabilizes and maintains the equilibrium concentration of peroxycarboxylic acid.

Specific examples of suitable $C_1$–$C_6$ carboxylic acids which can be used to make the peroxycarboxylic acid materials or to combine with hydrogen peroxide to form peroxyacid materials include such saturated fatty acids as methanoic, acetic acid, propionic acid, butyric acid, pentanoic, hexanoic acid, and mixtures thereof. Further, the carboxylic and peroxycarboxylic acids useful in this invention include $C_{1-6}$ carboxylic and peroxycarboxylic acids and derivatives thereof including acid-esters, acid salts, and shorter and longer chain acids present as contaminants.

These acids can be drawn from both natural or synthetic sources. Natural sources include animal and vegetable fats or oils which should be fully hydrogenated. Synthetic acids can be produced by the oxidation of petroleum wax. One carboxylic acid preferred for use in the composition of the invention comprises acetic acid or acetic acid as blended with other $C_{1-6}$ carboxylic acids. The preferred carboxylic acid is acetic acid which produces peroxycarboxylic acid to increase the sanitizing effectiveness of the materials.

The composition of the invention also comprises an oxidizer. Any number of oxidizers may be used as a precursor to the formation of a peroxycarboxylic acid. Generally, the antimicrobial composition of the invention comprises hydrogen peroxide. Hydrogen peroxide in combination with the carboxylic acid and peroxycarboxylic acid provides a surprising level of antimicrobial action against microorganisms, even in the presence of high loadings of organic sediment.

An additional advantage of hydrogen peroxide is the acceptability of these compositions on food contact surfaces, upon use and decomposition. For example, combinations of peroxy acetic acid and hydrogen peroxide result in acetic acid, water, and oxygen, upon decomposition. All of these constituents are food product compatible.

Hydrogen peroxide ($H_2O_2$), has a molecular weight of 34.014 and it is a weakly acidic, clear, colorless liquid. The four atoms are covalently bonded in a H—O—O—H structure. Generally, hydrogen peroxide has a melting point of −0.41° C., a boiling point of 150.2° C., a density at 25° C. of 1.4425 grams per cm3, and a viscosity of 1.245 centipoise at 20° C.

Generally, the concentration of hydrogen peroxide within the composition used in the process of the invention ranges from about 1 wt-% to about 50 wt-%, preferably from about 3 wt-% to about 40 wt-%, and most preferably from about 10 wt-% to about 30 wt-% in the concentrate, prior to use. This concentration of hydrogen peroxide is most preferred as providing optimal antimicrobial effect.

In all, altering the concentration of the oxidizing agent will effect the equilibrium mix of the peroxycarboxylic acid used in the invention.

The other principle component of the antimicrobial composition of the invention is an oxidized carboxylic acid. This oxidized or peroxycarboxylic acid provides heightened antimicrobial efficacy when combined with hydrogen peroxide and the monocarboxylic acid in an equilibrium reaction mixture. Percarboxylic acids generally have the formula $R(CO_3H)_N$, where R is an alkyl, arylalkyl, cycloalkyl, aromatic or heterocyclic group, and N is one or more.

While peroxy carboxylic acids are not very stable, their stability generally increases with increasing molecular weight. Thermal decomposition of these acids may generally proceed by free radical and nonradical paths, by photodecomposition or radical-induced decomposition, or by the action of metal ions or complexes. Percarboxylic acids may be made by the direct, acid catalyzed equilibrium action of 30–98 wt-% hydrogen peroxide with the carboxylic acid, by autoxidation of aldehydes, or from acid chlorides, or carboxylic anhydrides with hydrogen or sodium peroxide.

Peroxycarboxylic acids useful in this invention include $C_{1-6}$ peroxycarboxylic acids such as permethanoic peracetic acid, perpropanoic acid, perbutanoic acid, perpentanoic acid, perhexanoic acid and mixtures thereof. These percarboxylic acids have been found to provide good antimicrobial action with good stability in aqueous streams.

In a more preferred mode, the process of the invention uses peracetic acid. Peracetic acid is a peroxy carboxylic acid having the formula:

$$CH_3COOOH.$$

Generally, peracetic acid is a liquid having an acrid odor and is freely soluble in water, alcohol, ether, and sulfuric acid. Peracetic acid may be prepared through any number of means known to those of skill in the art including preparation from acetaldehyde and oxygen in the presence of cobalt acetate. A 50% solution of peracetic acid may be obtained by combining acetic anhydride, hydrogen peroxide and sulfuric acid. Other methods of formulation of peracetic acid include those disclosed in U.S. Pat. No. 2,833,813, which is incorporated herein by reference.

The preferred peroxy acetic acid materials of the invention can be used to increase the sanitizing effectiveness of the materials. When a blended acid is used, the peroxy acetic acid is blended in proportions that range from about 1 to about 50 parts of peroxy acetic acid per each part of other peroxycarboxylic acid. Preferably, the peroxy acetic acid is used at a ratio of about 8 parts per part of other peroxycarboxylic acid.

The above sanitizer material can provide antibacterial activity to the rinse aid sanitizers of the invention against a wide variety of microorganisms such as gram positive (for example, *Staphylococcus aureus*) and gram negative (for example, *Escherichia coli*) microorganisms, yeast, molds, bacterial spores, viruses, etc.

The composition of the invention also comprises a carrier. The carrier functions to provide a reaction medium for the solubilization of constituents and the production of percarboxylic acid as well as a medium for the development of an equilibrium mixture of oxidizer, percarboxylic acid, and carboxylic acid. The carrier also functions to deliver and wet the antimicrobial composition of the invention to the intended substrate.

To this end, the carrier may comprise any aqueous or organic component or components which will facilitate these functions. Generally, the carrier comprises water which is an excellent solubilizer and medium for reaction and equilibrium. Water is also readily accepted in ware washing environments. The carrier may also comprise any number of other constituents such as various organic compounds which facilitate the functions provided above.

Organics which can be useful include simple alkyl alcohols such as ethanol, isopropanol, n-propanol, and the like. Polyols are also useful carriers in accordance with the invention, including propylene glycol, polyethyleneglycol, glycerol, sorbitol, and the like. Any of these compounds may be used singly or in combination with other organic or inorganic constituents or, in combination with water or in mixtures thereof.

Generally, the carrier comprises a large portion of the composition of the invention and may essentially be the balance of the composition apart from the active antimicrobial composition, adjuvants, and the like. Here again, the carrier concentration and type will depend upon the nature of the composition as a whole, the environment of storage and method of application including concentration of the antimicrobial agent, among other factors. Notably the carrier should be chosen and used at a concentration which does not inhibit the antimicrobial efficacy of the active in the composition of the invention.

B. Adjuvants

The composition of the invention may also optionally comprise any number of adjuvants which are stable in an oxidizing environment, and add beneficial properties of stability, sequestration, sheeting and rinsing, etc. These adjuvants may be preformulated with the rinse aid of the invention or added to the system simultaneously, or even after, the addition of the rinse aid of the invention.

STABILIZER

The composition of the invention may also contain a polyvalent metal complexing or chelating agent that aids in reducing the harmful effects of hardness components and service water. The typically harmful effects of calcium, magnesium, iron, manganese, etc., ions present in service water can interfere with the action of either the washing compositions or rinsing compositions or can tend to decompose the active peroxygen sanitizer materials. The chelating agent or sequestering agent can effectively complex and remove such ions from inappropriate interaction with active ingredients thus increasing rinse aid performance.

Both organic and inorganic chelating agents may be used. Inorganic chelating agents include such compounds as sodium tripolyphosphate and other higher linear and cyclic polyphosphate species. Organic chelating agents include both polymeric and small molecule chelating agents. Small molecule organic chelating agents include salts of ethylene diamine tetraacetic acid, diethylene triamine penta acetic acid, nitrilotriacetic acid, ethylene diamine propionates, triethylene tetraamine hexacetates and the respective alkali metal, ammonium and substituted ammonium salts thereof. Polymeric chelating agents commonly comprise polyanionic compositions such as polyacrylic acid compounds. Amino phosphates and phosphonates are also suitable for use as chelating agents in the compositions of the invention and include ethylene diamine (tetramethylene phosphonates), nitrilotrismethylene phosphates, diethylenetriamine (pentamethylene phosphonates). These amino phosphonates commonly contain alkyl or alkaline groups with less than 8 carbon atoms.

Preferred chelating agents for use in this invention include improved food additive chelating agents such as disodium salts of ethylene diamine tetraacetic acid or the well known phosphonates sold in the form of DEQUEST® materials, for example, 1-hydroxyethylidene-1,1-diphosphonic acid, etc. The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid. Other organic phosphonic acids include those available from Monsanto Industrial Chemicals Co., St. Louis, Mo., such as DEQUEST® 2010, which is a 58–62% aqueous solution; amino [tri(methylenephosphonic acid)] ($N[CH_2PO_3H_2]_3$), available from Monsanto as DEQUEST® 2000, as a 50% aqueous solution; ethylenediamine [tetra (methylenephosphonic acid)] available from Monsanto as DEQUEST® 2041, as a 90% solid acid product; and 2-phosphonobutane-1,2,4-tricarboxylic acid available from Mobay Chemical Corporation, Inorganic Chemicals Division, Pittsburgh, Pa., as Bayhibit AM, as a 45–50% aqueous solution.

The above-mentioned phosphonic acids can also be used in the form of water soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used.

RINSE AGENT

A component which may be added to or used with the composition of the invention is a rinse agent such as a surfactant system used to promote sheeting. Generally, any number of surfactants may be used consistent with the purpose of this constituent. For example the surfactant rinse agent may comprise a nonionic, anionic, cationic, or amphoteric surfactant.

These surfactant rinse aids may be present in the sanitizing, destaining concentrate of the invention as formulated. Alternatively, these rinse agents may be introduced during application to the ware. In such an instance, regardless of whether automated or manual, the rinse agent may be combined with the concentrate of the invention prior to application or codispensed separately during application.

Anionic surfactants useful with the invention comprise alkyl carboxylates, linear alkylbenzene sulfonates, paraffin sulfonates and secondary n-alkane sulfonates, sulfosuccinate esters and sulfated linear alcohols.

Zwitterionic or amphoteric surfactants useful with the invention comprise β-N-alkylaminopropionic acids, n-alkyl-β-iminodipropionic acids, imidazoline carboxylates, n-alkylbetaines, amine oxides, sulfobetaines and sultaines.

Generally, these surfactants find preferred use in manual applications. The choice of surfactants depends on the foaming properties that the individual, or combination, of surfactants bring to the composition of the invention.

Nonionic surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene (PO)-polyoxyethylene (EO) block copolymers. These surfactants comprise a diblock polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecule. The average molecular weight of useful surfactants ranges from about 1000 to about 40,000 and the weight percent content of ethylene oxide ranges from about 10–80% by weight.

Also useful in the context of this invention are surfactants comprising alcohol alkoxylates having EO, PO and BO blocks. Straight chain primary aliphatic alcohol alkoxylates can be particularly useful as sheeting agents. Such alkoxylates are also available from several sources including BASF Wyandotte where they are known as "Plurafac" surfactants. A particular group of alcohol alkoxylates found to be useful are those having the general formula $R—(EO)_m–(PO)_4$ wherein m is an integer of about 2–10 and n is an integer from about 2–20. R can be any suitable radical such as a straight chain alkyl group having from about 6–20 carbon atoms.

Other useful nonionic surfactants of the invention comprise capped aliphatic alcohol alkoxylates. These end caps include but are not limited to methyl, ethyl, propyl, butyl, benzyl and chlorine. Preferably, such surfactants have a molecular weight of about 400 to 10,000. Capping improves the compatibility between the nonionic and the oxidizers hydrogen peroxide and percarboxylic acid, when formulated into a single composition. An especially preferred nonionic is Plurafac LF131 from BASF with a structure $C_{12-7}(EO)_7(BO)_{1.7}R$ wherein R is a $C_{1-6}$ alkyl moiety and preferably with 60% of the structures being methyl capped, R comprises $CH_3$. Other useful nonionic surfactants are alkylpolyglycosides.

Another useful nonionic surfactant of the invention comprises a fatty acid alkoxylate wherein the surfactant comprises a fatty acid moiety with an ester group comprising a block of EO, a block of PO or a mixed block or heteric group. The molecular weights of such surfactants range from about 400 to about 10,000, a preferred surfactant comprises an EO content of about 30–50 wt-% and wherein the fatty acid moiety contains from about 8 to about 18 carbon atoms.

Similarly, alkyl phenol alkoxylates have also been found useful in the manufacture of the rinse agents of the invention. Such surfactants can be made from an alkyl phenol moiety having an alkyl group with 4 to about 18 carbon atoms, can contain an ethylene oxide block, a propylene oxide block or a mixed ethylene oxide, propylene oxide block or heteric polymer moiety. Preferably such surfactants have a molecular weight of about 400 to about 10,000 and have from about 5 to about 20 units of ethylene oxide, propylene oxide or mixtures thereof.

SOLUBILIZER

The compositions of the invention may also include a hydrotrope coupler or solubilizer. Such materials can be used to ensure that the composition remains phase stable and in a single highly active aqueous form. Such hydrotrope solubilizers or couplers can be used in compositions which maintain phase stability but do not result in unwanted compositional interaction.

Representative classes of hydrotrope solubilizers or coupling agents include an anionic surfactant such as an alkyl sulfate, an alkyl or alkane sulfonate, a linear alkyl benzene or naphthalene sulfonate, a secondary alkane sulfonate, alkyl ether sulfate or sulfonate, an alkyl phosphate or phosphonate, dialkyl sulfosuccinic acid ester, sugar esters (e.g., sorbitan esters) and a $C_{8-10}$ alkyl glucoside.

Preferred coupling agents for use in the rinse agents of the invention include n-octane sulfonate and aromatic sulfonates such as an alkyl benzene sulfonate (e.g., sodium xylene sulfonate or naphthalene sulfonate). Many hydrotrope solubilizers independently exhibit some degree of antimicrobial activity at low pH. Such action adds to the efficacy of the invention but is not a primary criterion used in selecting an appropriate solubilizing agent. Since the presence of the per acid material in the protonated neutral state provides beneficial biocidal or sanitizing activity, the coupling agent should be selected not for its independent antimicrobial activity but for its ability to provide effective single phase composition stability in the presence of substantially insoluble per acid materials and the more soluble compositions of the invention.

C. Formulation

The compositions of the invention can be formulated by combining the rinse agent materials including other adjuvant components with the materials that form the sanitizer composition, the carboxylic acid or acid blend, hydrogen peroxide and optionally, hydrotrope solubilizer.

The compositions can also be formulated with preformed peroxy acids. The preferred compositions of the invention can be made by mixing the carboxylic acid or mixture thereof with an optional hydrotrope solubilizer or coupler, reacting the mixture with hydrogen peroxide and then adding the balance of required ingredients to provide rinsing and sanitizing action.

A stable equilibrium mixture is produced containing the carboxylic acid or blend with hydrogen peroxide and allowing the mixture to stand for 1–7 days at 15° C. or more. With this preparatory method, an equilibrium mixture will be formed containing an amount of hydrogen peroxide, unoxidized acid, oxidized or per acid and typically unmodified couplers, solubilizer, or stabilizers.

D. Concentrated Use Compositions

The invention contemplates a concentrate composition which is diluted to a use solution prior to its utilization as a sanitizer. Primarily for reasons of economics, the concentrate would normally be marketed and an end user would preferably dilute the concentrate with water or an aqueous diluent to a use solution.

The general constituent concentrations of the sanitizer concentrate formulated in accordance with the invention may be found in the Table below.

TABLE

| | CONCENTRATE (wt %) -at Equilibrium- | | |
|---|---|---|---|
| Constituent | Preferred | More Preferred | Most Preferred |
| $H_2O_2$ | 1–50 | 3–40 | 10–30 |
| Peroxy acid | 0.5–25 | 1–20 | 3–15 |
| Carboxylic acid | 2–70 | 5–50 | 5–40 |
| Stabilizer | 0–5 | 0.7–4 | 0.8–1.5 |
| Solubilizer | 0–20 | 0–15 | 0–10 |
| Rinse Agent | 0–40 | 5–35 | 10–30 |
| Carrier | Balance | Balance | Balance |

The level of active components in the concentrate composition is dependent on the intended dilution factor and the desired activity of the surfactant and peroxy fatty acid compound and the desired acidity in the use solution. Generally, dilution of about 1 fluid ounce of concentrate to about 1–15 gallons of water, i.e. a dilution of from about 1 part of concentrate to 125 parts by volume of water up to about 1 part of concentrate to 2000 parts by volume of water can be obtained with 2 to about 20 wt-% total per acid in the concentrate. At this rate, the composition shown in the preferred column of Table shown above may be used at a rate of about 500 ppm to 4000 ppm in the rinsing environment. Higher use dilutions can be employed if elevated use temperature (greater than 20° C.) or extended exposure time (greater than 30 seconds) can be employed. In the typical use locus, the concentrate is diluted with a major proportion of water and used for destaining and sanitizing using commonly available tap or service water mixing the materials at a dilution ratio of about 0.5 to about 10 ounces of concentrate per each 8 gallons of water.

At equilibrium, aqueous antimicrobial sanitizing use solutions can comprise at least about 1 part per million, preferably about 10 to 400 ppm, and more preferably about 10 to 200 parts per million of the peroxyfatty acid material, about 20 ppm to 650 ppm, and preferably about 20 ppm to 400 ppm of carboxylic acid; at least about 20 parts per million, typically about up to 300 parts per million and preferably about 15 to 200 parts per million, and most preferably about 40 to 160 parts per million of the sheeting or rinsing agent; and about 100 to about 1200 parts per million and preferably about 20 to 500 parts per million of hydrogen peroxide. The aqueous use solution can further comprise at least about 1 ppm, preferably about 2 to about 20 ppm of the hydrotrope solubilizer, and have a pH in the use solution in the range of about 2 to about 9, preferably about 3 to about 8.

In use, the composition of the invention may be combined with a surfactant rinse aid. The surfactant rinse aid may be used in the desired environment at the following concentrations (wt-%):

| | Preferred | More Preferred | Most Preferred |
|---|---|---|---|
| Surfactant Rinse Aid | 0.0002–0.005 | 0.0003–0.002 | 0.0004–0.002 |

E. Methods of Use

As noted above, compositions of the invention are useful in rinsing steps of manual washing procedures as well as commonly available ware washing machines.

The sanitizing destaining concentrate of the invention may be used in any manual procedure known to those of skill in art. One example of such a procedure is a three tub washing procedure for washing, rinsing, and sanitizing ware. Generally such procedures take place at temperatures ranging from about 200° C. to 35° C.

While the configuration and construction of ware washing machines do vary from high temperature to low temperature machines and from manufacturer to manufacturer, all machines share common operating parameters in that the aqueous rinse compositions are sprayed on dishes in a rinse step at a generally fixed temperature for a generally fixed period of time. In such machines, the aqueous rinse composition is prepared by diluting rinse agent with an appropriate proportion of water, placing the aqueous rinse in a sump or other container and drawing and spraying the aqueous rinse from the sump. Such aqueous rinses often sprayed through nozzles attached to rotating bars or fixed sprayer nozzles attached or installed in the ware washing machine in a location that optimizes contact between the aqueous rinse and ware.

The nozzles are often manufactured with a geometry that enhances a spray pattern for complete coverage. The spray arms can be fixed or can reciprocate or rotate within the machine providing complete coverage. The aqueous diluted concentrate of the invention in a low temperature machine can be pumped at a rate of about 20 to 100, preferably 40 to 80 gallons per minute and is commonly contacted with dishes at temperatures between 120 and 140° F. In a high temperature machine, the aqueous rinse is sprayed at a rate of 1.0–2.5 gallons per rack of dishes at a temperature of about 150 to 190° F. The rinse cycle can extend in time for from about 7 to about 30 seconds, preferably about 10 to 20 seconds to ensure that the dishes are both fully rinsed and sanitized in the rinsing stage. The term "sanitizing" is used in the description and methods of the invention indicates a reduction in the population of numbers of undesirable microorganisms by 5 orders of magnitude or greater (99.999% reduction) after a 30 second exposure time. In other words, 99.999% of the microbial population present in a test site are eliminated by using the composition of the invention, as measured by Germicidal and Detergent Sanitizing Action of Disinfectants, Official Methods of Analysis of the Association of Official Analytical Chemists, paragraph 960.09, and applicable subparagraphs, 15th Edition.

WORKING EXAMPLES

The following example is intended to illustrate the invention and should not be construed to narrow its scope. One skilled in the art will readily recognize that these examples suggest many other ways in which the invention can be practiced.

Working Example 1

A rinse agent composition was prepared by blending 0.79 grams of a rinse agent composition comprising an aqueous rinse aid comprising 10 wt-% LF 428 (benzyl capped linear alcohol ethoxylate), 10 wt-% D 097 (a EO/PO block copolymer terminated with PO), 1 wt-% of a nonyl phenol ethoxylate having 9.5 moles of ethylene oxide, 0.1 wt-% of ethylene diamine tetraacetic acid sodium salt, 0.08 wt-% of a 37 wt-% active aqueous formaldehyde solution, 14 wt-% of a sodium xylene sulfonate (40 wt-% active aqueous solution) and 0.015 wt-% of a green dye blended with a material selected from the group consisting of 6.23 grams of sodium hypochlorite (9.8 wt-% active aqueous NaoCl) (Example 1A), 13.4 grams of peracetic acid preparation (Example 1B) or 6.7 grams of a peracetic acid preparation (Example 1C). The peracetic acid preparation comprises 28.3 wt-% of hydrogen peroxide, 8 wt-% of acetic acid, 5.8% peracetic acid, 0.9 wt-% of a phosphonate stabilizer comprising hydroxyethylidene diphosphonic acid and the balance being water.

These three materials were used in a machine ware washing experiment wherein drinking glasses were washed and rinsed. A wash cycle was used in which 7.37 grams of a commercial dishwashing detergent was introduced into the wash cycle. In conducting the experiment, city water having 125 ppm total dissolved solids and softened well water containing 255 ppm total dissolved solids were used. In each experiment a 20 cycle machine evaluation with 10 minutes dry time between cycles was used. Glasses were evaluated at the end of 20 cycles for film and spots, although filming was taken to be a more reliable indicator of glass appearance in the test. Heavily filmed glasses do not show spots well because a heavy film prevents appearance of spots. In these tests the dish machine has a 1.7 gallon sump. Into each batch of wash water was added 2.14 grams of pureed beef stew soil and 1.07 grams of "hot point" soil. A set of test glasses (during the 20 cycle test) was dipped into whole milk and dried at 100° F. for 10 minutes between each cycle. The other set of glasses was not dipped into milk, but allowed to air dry between cycles. The milk soiled glass duplicates the soiling and drying of soil experienced in restaurant conditions. Water temperature was maintained between 130–140° F. Each glass was graded by three separate graders. Filming was graded in a dark room black box and the results are the consensus value of the three film grade criteria are as follows: no film=1.0; trace of film=2.0; light film visible under normal lighting conditions=3.0; moderate film=4.0; and heavy film=5.0.

TABLE I

Film results for the 20 cycle tests are as follows:

| SANITIZER | FILM GRADES Softened Grade | | City Grade | |
|---|---|---|---|---|
| Example 1(a) with sodium hypochlorite | with milk | 4.0 | with milk | 3.7 |
| | w/o milk | 3.5 | w/o milk | 2.5 |
| Example 1(b) with peracetic acid (high dose) | with milk | 1.0 | with milk | 1.6 |
| | w/o milk | 1.6 | w/o milk | 1.4 |
| Example 1(c) with peracetic acid (low dose) | with milk | 1.7 | with milk | 1.9 |
| | w/o milk | 1.7 | w/o milk | 1.9 |

An examination of the data shown in Table I demonstrates that the use of chlorine bleach in a rinse agent results in substantial filming on common glassware. The use of a peracetic acid hydrogen peroxide sanitizer in combination with a low foaming rinse agent produces substantially improved filming when compared with the hypochlorite based rinse sanitizer system.

Working Example 2

A further analysis of the antimicrobial nature of the invention was undertaken using the Germicidal and Detergent Sanitizer Test, (Official Final Action, A.O.A.C. Methods of Analysis 15th Edition, 1990, 960.09 A–J). The test system was prepared by aseptically adding 5 ml of phosphate buffer to a 24 hr. agar slant of each test system. The growth was washed off and rinsed back into phosphate buffer. The suspension was then mixed well and 2 ml of this suspension was placed onto each French slant. The slants were tilted back and forth to completely cover the surface. The excess suspension was decanted off and the slants were incubated at 37° C. for 18–24 hours.

After incubation, the test system was removed from the French slant agar surface by adding 3 ml phosphate buffer and sterile glass beads. The beads were then rotated back and forth to remove the growth. The suspension was filtered through Buchner Funnel with Whatman No. 2 filter paper and collected in a sterile test tube. Standardization of both test systems was performed on spectrophotometer at 580 nm. Standardization was as follows:

*S. aureus*

Initial % T=0.3.

24 ml of phosphate buffer was then added.

Final % T=1.2.

A test substance was prepared for testing in this case. The test substance had the following composition:

| constituent | wt % |
|---|---|
| peroxyacetic acid | 5.25 |
| hydrogen peroxide | 24.15 |
| inert ingredients (including carrier) | 70.60 |

In operation, 100 ml of prepared test substance was dispensed into a 100 ml volumetric and 1 ml was removed. This 99 ml was dispensed into a sterile 250 ml erlenmeyer flask, placed into a 120° F. (48.89° C.) water bath and allowed to equilibrate for 10 minutes. Then, 1 ml of test system was added to the flask while swirling. After a 30 second exposure, 1 ml was transferred into 9 ml neutralizer. Samples were enumerated using serial dilutions. Incubation was at 37° C. for 48 hours.

The neutralizer was prepared with 1% sodium thiosulfate, (J.T. Baker Chemical Co., Phillipsburg, N. J.), 1% Peptone, (Difco Laboratories, Detroit, Mich.); and 1 g Sodium Thiosulfate+1 g Peptone/90 ml distilled water. This was dispensed and autoclaved as concentrated Thiopeptone. Also added was 0.025% Catalase, (Sigma Chemical Co., St. Louis, Mo.).

On the test date, 0.025% Catalase was prepared by adding 0.125 g Catalase into 50 ml water. This solution was filter sterilized through a 0.45 =m filter. Then, 10 ml of 0.025% Catalase was added to 90 ml Thiopeptone and mixed. 9 ml of this solution was dispensed into 25 mm×150 mm test tubes to be used as the neutralizer.

TABLE II

RESULTS
Test Temperature: 120° F. (48.89° C.) ± 0.2° C./Test Exposure Time: 30 seconds
Plating Medium: Trypticase Glucose Extract Agar
Difco Laboratories, Detroit, Michigan $$\text{Percent Reduction}(\%\ R) = \frac{\text{Initial Inoculum} - \text{Survivor Numbers}}{\text{Initial Inoculum}} \times 100$$

| Example | Test Water | Initial Inoculum (cfu/ml) | Survivors Numbers (cfu/ml) | Percent Reduction |
|---|---|---|---|---|
| Staphylococcus aureus ATCC 6538 | | | | |
| 2A | 500 ppm | $7.97 \times 10^7$ | <10 | 99.999 |
| 2B | 500 ppm | $7.97 \times 10^7$ | <10 | 99.999 |
| Escherichia coli ATCC 11229 | | | | |
| 2A | 500 ppm | $1.01 \times 10^8$ | <10 | 99.999 |
| 2B | 500 ppm | $1.01 \times 10^8$ | <10 | 99.999 |

CONCLUSION

The test substance at a concentration of 1 oz/8 gallons which is 0.098% (1.96 ml product in 1998.04 ml diluent) diluted in 500 ppm synthetic hard water (as $CaCO_3$), has been shown to be an effective sanitizer on inanimate food contact surfaces against *Staphylococcus aureus* and *Escherichia coli* by yielding a 99.999% reduction within a 30 second exposure time at 120° F. (48.89° C.).

Working Example 3

Corrosion Experiments

A series of experiments were carried out to measure the relative corrosive action of hypochlorite solutions versus the concentrate composition of the invention on stainless steel. In one series of tests, these solutions were dripped onto hot stainless steel to simulate what one sees in the field when a feed line breaks, causing the undiluted solution to drip onto the outside of the hot warewashing machine. Two 8×8 inch panels, one made of 304 stainless steel and the other from 316 stainless steel, were each divided into four sections and placed in an oven at 100° F. Each section of each plate was treated with 10 drops of one of the following solutions daily.

| EXAMPLE | COMPOSITION |
|---|---|
| COMPARATIVE EXAMPLE 3A | Hypochlorite solution of 6.0% Available Chlorine |
| COMPARATIVE EXAMPLE 3B | Hypochlorite solution of 4.8% Available Chlorine |
| COMPARATIVE EXAMPLE 3C | Hypochlorite solution of 2.1% Available Chlorine |
| WORKING EXAMPLE 3A | Peracetic Acid solution of 5% Peracetic Acid |

The panels were treated in this manner over a period of two months. The panels were rinsed with water at the end of each week during this period and observed. At the end of two weeks, the section of both panels treated with the hypochlorite solutions (Comparative Examples 3A–3C) began to corrode, but the sections treated with the peracetic acid solutions (Working Example 3A), did not.

Over the two month period, the hypochlorite treated surfaces grew progressively worse and exhibited brown discolorations and pitting whereas the peracetic acid treated surfaces showed no change except for a slight lightening.

Working Example 4

An example of the destaining capability of the sanitizer was demonstrated using a Hobart ET-40 double rack dish machine and softened water at a temperature between 120°–140° F. The per acid sanitizer was the same as that specified in Example 1B. This concentration works out to be 23 ml per rinse cycle.

At the beginning of the test, the coffee and tea cups were badly stained. The test was conducted for one week. During this time, the coffee and tea cups were used and washed in the normal manner. At the end of the one week test, the coffee and tea cups were examined and found to have been destained.

The above specification, examples and data provide a complete description of the manufacture and use of the composition of the invention.

Since many embodiments of the invention can be made without departing from the spirit and scope of the invention, the invention resides in the claims hereinafter appended.

We claim:

1. A method of sanitizing and destaining dishware, kitchenware and tableware products, said method comprising the step of applying an effective sanitizing amount of a sanitizing, destaining concentrate composition to the ware in an automated wash machine, said concentrate composition comprising from about 0.5 to 25 wt-% of a mixture of a peroxycarboxylic acid selected from the group consisting of permethanoic, peracetic, perpropanoic, perbutanoic, perpentanoic and perhexanoic acid; from about 2 to 70 wt-% of a carboxylic acid selected from the group consisting of methanoic, acetic, propionic, butyric, pentanoic, and hexanoic acid; from about 1 to 50 wt-% of hydrogen peroxide, and a balance of carrier, wherein said concentrate composition is diluted upon application to a concentration ranging from about 600 ppm to 4000 ppm.

2. The method of claim 1 wherein said automated wash machine applies said concentrate composition at a temperature ranging from about 120° F. to 140° F.

3. The method of claim 1, wherein said concentrate composition is applied to the ware in combination with a surfactant rinse aid.

4. The method of claim 3 wherein said sanitizing, destaining concentrate composition and said rinse aid are intermixed prior to application.

5. The method of claim 3 wherein said sanitizing, destaining concentrate composition and said rinse aid are separately applied at the same time during application.

6. The method of claim 3, wherein said surfactant is selected from the group consisting of a nonionic surfactant, an anionic surfactant, a zwitterionic surfactant, and mixtures thereof.

7. The method of claim 1 wherein said carrier is water.

8. A method of sanitizing and destaining kitchenware, dishware and tableware, said method comprising the step of applying a sanitizing and destaining concentrate composition to the ware in an automated wash machine, said concentrate composition comprising from about 0.5 to 25 wt-% of peroxy acetic acid, from about 2 to 70 wt-% of acetic acid, from about 1 to 50 wt-% of hydrogen peroxide, and a balance of carrier, wherein said concentrate composition is diluted upon application to a concentration ranging from about 600 ppm to 4000 ppm.

9. The method of claim 8 wherein said automated wash machine operates at a temperature ranging from about 120° F. to 140° F.

10. The method of claim 8, wherein said sanitizing and destaining concentrate composition is applied to said ware in combination with a surfactant rinse aid.

11. The method of claim 10, wherein said surfactant is selected from the group consisting of a nonionic surfactant, an anionic surfactant, a zwitterioinic surfactant, and mixtures thereof.

12. The method of claim 10 wherein said sanitizing, destaining concentrate composition and said rinse aid are intermixed prior to application.

13. The method of claim 10 wherein said sanitizing, destaining concentrate composition and said rinse aid are separately applied at the same time during application.

14. The method of claim 8 wherein said carrier is water.

* * * * *